United States Patent [19]

Bullard

[11] Patent Number: 4,762,430

[45] Date of Patent: Aug. 9, 1988

[54] RIBBED DRAW TAPE FOR THERMOPLASTIC BAG

[75] Inventor: Edward M. Bullard, East Rochester, N.Y.

[73] Assignee: Mobil Oil Corporation, New York, N.Y.

[21] Appl. No.: 71,296

[22] Filed: Jul. 9, 1987

[51] Int. Cl.[4] ..... B65D 33/28

[52] U.S. Cl. ..... 383/75; 53/413

[58] Field of Search ..... 383/17, 75; 53/413; 493/225, 226, 926, 928

[56] References Cited

U.S. PATENT DOCUMENTS

| | | | |
|---|---|---|---|
| 1,751,473 | 3/1930 | Deubener | 383/17 |
| 3,029,853 | 4/1962 | Piazze . | |
| 3,506,048 | 4/1970 | Jortikka | 383/75 |
| 4,165,832 | 8/1979 | Kuklies . | |
| 4,558,463 | 12/1985 | Boyd | 383/75 |
| 4,628,536 | 12/1986 | Herrington | 383/75 |

FOREIGN PATENT DOCUMENTS

| | | | |
|---|---|---|---|
| 1125363 | 8/1968 | United Kingdom . | |
| 2009098 | 6/1979 | United Kingdom | 383/75 |

*Primary Examiner*—Stephen P. Garbe
*Attorney, Agent, or Firm*—Alexander J. McKillop; Michael G. Gilman; Charles J. Speciale

[57] ABSTRACT

Draw tape bags for carrying trash have a draw tape with ribs extending across the width of the tape, each rib having a thickness greater than the thickness of the tape. The ribs prevent roping of the draw tape handle when a loaded bag is lifted. Roping is prevented because the packing of the ribs is not uniform, thereby creating free space between the ribs. Triangular and cylindrical elements are embedded in the tape to form the ribs.

14 Claims, 1 Drawing Sheet

RIBBED DRAW TAPE FOR THERMOPLASTIC BAG

FIELD OF THE INVENTION

The present invention relates to thermoplastic tape handles inserted in thermoplastic bags, and in particular, to a tape configuration especially designed to reduce stress concentration, commonly known as "roping", while the bag is under load.

BACKGROUND OF THE INVENTION

Bags made of thin polyethylene material have been used in various sizes. Small bags are used in packaging of sandwiches and the like. Larger bags are used as shopping bags. Even large bags are used for containing trash.

A particularly advantageous closure for such a bag includes a draw tape constructed from the same polyethylene material. U.S. Pat. No. 3,029,853—Piazzi, and British Pat. No. 1,125,363—Jortikka are examples of draw tape bags. Such closures have been successfully employed on these bags.

Draw tape closures for large trash bags, and the manufacture of these draw tape trash bags, are described in the related applications identified below.

In the past, thermoplastic bag structures with handle elements have been produced by a method which reduces stress concentration. Stress points around the bag mouth are distributed to areas which are less likely to rupture as a result of stress concentration. See U.S. Pat. No. 4,165,832—Kuklies, et al. This patent discloses a thermoplastic bag structure with integral handle elements and stress relief notches positioned at opposite ends of the mouth.

Previous handle configurations for thermoplastic bags have been characterized by exhibiting the effect of "roping" while the bag is under load. According to the Kuklies, et al patent, stress concentration causes a thermoplastic handle to form a rope while under load, such rope having a diameter given by:

$$D=(8WG/\pi)^{\frac{1}{2}}$$

where D is the diameter, W is the width of the handle structure, and G is the gauge, in mils, of the structure.

A decrease in the gauge of a thermoplastic handle exhibiting the above characteristic would give a rope of a decreased diameter. A thermoplastic bag handle forming a rope of a smaller diameter will cause more discomfort to the carrier of such a bag, due to a decreased area of distribution of the weight of the bag upon the hand of the carrier.

It is desirable to produce a thermoplastic bag handle of a smaller gauge, less costly material, without decreasing the diameter of the rope which such a handle will form while under load.

RELATED APPLICATIONS

"METHOD AND APPARATUS FOR MANUFACTURING DRAW TAPE BAGS", Boyd, et al, Ser. No. 652,254, filed Sept. 20, 1984, describes an overall draw tape bag manufacturing line; "METHOD & APPARATUS FOR FORMING HEMS IN SUPERPOSED PLIABLE PANELS", Boyd, et al, Ser. No. 652,255, now U.S. Pat. No. 4,617,008, issued Oct. 14, 1986, describes a hem forming apparatus used with the line; "INSERTION OF DRAW TAPE STRIPS IN DRAW TAPE BAG MANUFACTURE", Boyd, et al, Ser. No. 652,252, now U.S. Pat. No. 4,597,750, issued July 1, 1986, describes the apparatus for inserting the draw tape into the bag. "BAG HAVING INTERMITTENT ORIENTATION DRAW TAPE", Herrington, Ser. No. 722,045, now U.S. Pat. No. 4,628,536, issued Dec. 9, 1986, describes an intermittently oriented draw tape. The disclosures of the foregoing are incorporated herein by reference.

SUMMARY OF THE INVENTION

In accordance with the invention, a thermoplastic draw tape for a thermoplastic trash bag has transverse or angular ribs which reduce roping of the thermoplastic draw tape when lifting a loaded bag. When the draw tape is gripped to lift a loaded bag, the packing of the ribs on the draw tape will not be uniform, thereby creating free space between the ribs. This reduces the tendency to rope. In addition, the draw tape is stiffer in the transverse direction by reason of the presence of the ribs. This also reduces the tendency for roping.

Further in accordance with the invention, the ribs are triangular in cross-section and are spaced so that they are approximately 5% by weight or volume of the tape. The ribs of the present invention make it possible to use thinner, less costly tapes. For example, 1 mil tapes can be used without the objectionable roping of tapes during use. In the case of the 1 mil draw tape, the structure with ribs is 42% stiffer than an unribbed structure, and thus, less likely to rope.

In accordance with other embodiments of the invention, the ribs are cylindrical in cross-section, are embossed in the draw tape, or the ribs are embedded between two layers of tape.

The foregoing and other objects, features and advantages of the invention will be more apparent from the following detailed description and appended claims.

SHORT DESCRIPTION OF THE DRAWINGS

DESCRIPTION OF THE PREFERRED EMBODIMENT

Figure 1:
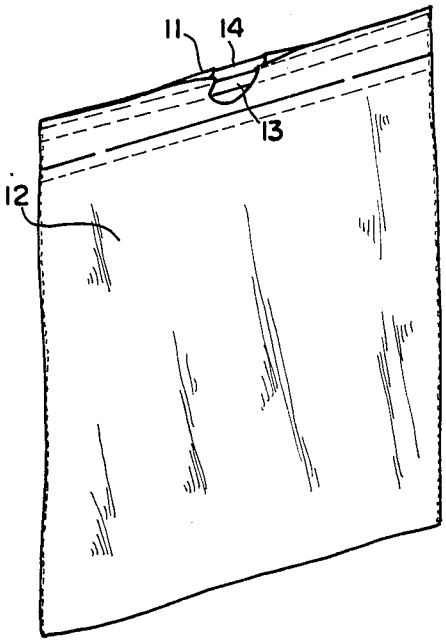
FIG. 1 shows a draw tape bag.

As shown in FIG. 1, a draw tape bag for carrying trash includes two panels 11 and 12. The two panels ar formed from an extruded tube of polyethylene. The sides of the panels are heat sealed and cut from the tube in a perpendicular direction. The tube is slit along the side to form an open top in the bag for reception of trash and the like. The hems of each panel are folded over adjacent the top. Draw tapes 13 and 14 are secured by the heat seal at the sides of the panels.

A cut-out in each panel and hem at the middle of the bag, exposes the draw tape so they can be grasped. When the bag is loaded with trash, the draw tape is grasped and lifted, thereby closing the bag. The draw tapes can thereafter be tied, forming a neat bundle.

Figure 2:
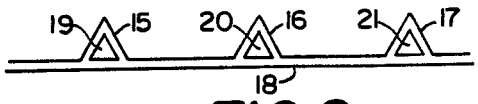
FIG. 2 shows a cross-section of the preferred embodiment of the draw tape.

In accordance with the present invention, the draw tape has a plurality of transverse ribs, 15-17 and others. Each rib has a thickness greater than the thickness of the tape 18. Each rib is formed by elements 19-21 which are stiff, relative to the tape 18. The elements are embedded in the tape transversely across the tape. Alternatively, the ribs may be formed at an angle to the transverse direction. As shown in FIG. 2, the ribs are triangular in cross-section and have two sides disposed at 45° angles with respect to the draw tape.

Figure 3:
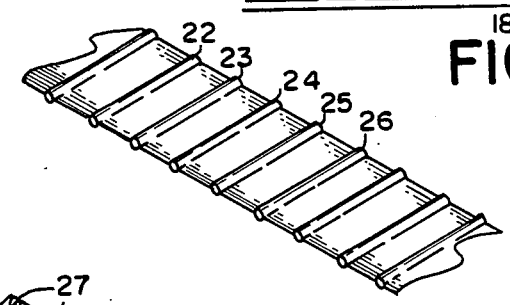
FIG. 3 is a perspective view of a tape with cylindrical ribs.

As shown in FIG. 3, the ribs 22-26 are formed by cylindrical elements embedded in the tape transversely or at an angle across the tape. Again, the ribs may be angularly disposed.

Figure 4:
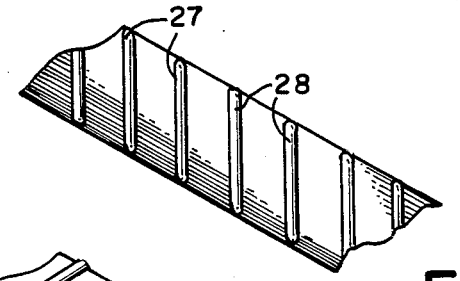
FIG. 4 shows a draw tape with embossed ribs.

As shown in FIG. 4, the ribs 27-29 are embossed in the tape to form areas of increased thickness in the tape. As shown in FIG. 4, the ribs are at a 45° angle to the transverse direction, but other angles, or transverse ribs, may be used.

Figure 5:
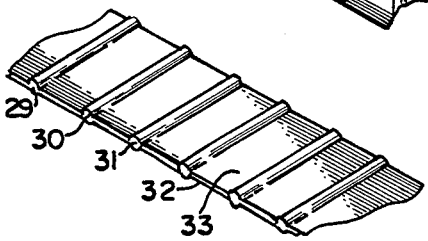
FIG. 5 shows ribs formed by elements embedded between two layers of tape.

The embodiment shown in FIG. 5 has cylindrical elements 29, 30, and 31 embedded between two layers 32 and 33 of tape.

The draw tape, the ribs, and the elements forming the ribs are high molecular weight, high density, polyethylene. Prevention of roping can be achieved by spacing ribs along the tape such that the ribs form approximately 5% by weight or volume of the tape.

Draw tapes for plastic trash bags are currently approximately 2 to 4 mils in gauge, but it is desired to reduce the tape gauge to 1 mil for economy reasons. A tape having a gauge of 1 mil±15% with ribs having a thickness of approximately 2 mil±15% provides less costly tape without the objectionable feature of roping of the tapes during use.

The reason for this is that the packing of the ribs will not be uniform and will create free space between the ribs. In addition, by beam theory, this structure will be stiffer in the transverse direction.

By beam theory, stiffness is:

$S=t^3E$ t=Thickness (mils)

E=Young Modulus

S=Stiffness

By example, a 1 mil tape is less stiff than a tape of the same nominal gauge with 5%, 2 mil ribs, on a 45° angle. Since both are made of the same material, the Young's modulus drops out and then:

$$(1)^3<(0.05)\ (2)^3/(\text{Cos } 45°)+(0.95)^3$$

$$(1)<0.566+0.857$$

$$1<1.42$$

Thus, the rib structure is 42% stiffer than the unribbed structure and less likely to rope.

While a particular embodiment of the invention has been shown and described, various modifications are within the true spirit and scope of the invention. The appended claims are, therefore, intended to cover all such modifications.

What is claimed is:

1. A thermoplastic draw tape bag for carrying trash and the like having a non-roping thermoplastic draw tape comprising:

two thermoplastic panels forming an open top, closed bottom bag, said panels being joined along the sides of said bag;

a hem on said panels being folded over adjacent said top, the bottom of said hem being secured to the adjacent panel;

a thermoplastic draw tape in said hem secured at said sides to said panels, said draw tape having a plurality of integral thermoplastic ribs extending across the width of the tape and spaced along the length of the tape, each rib having a thickness greater than the thickness of said tape whereby roping of said draw tape is reduced when said draw tape is gripped to lift a loaded bag.

2. The draw tape bag recited in claim 1 wherein each rib is transverse of the tape.

3. The draw tape bag recited in claim 1 wherein each rib is at an angle to the transverse direction across the tape.

4. The draw tape bag recited in claim 1, wherein each rib is formed by elements which are relatively stiff, relative to said tape, said elements being embedded in said

5. The draw tape bag recited in claim 4 wherein said tape is formed of two layers with said elements being embedded between said layers.

6. The draw tape bag recited in claim 4, wherein said elements embedded in said tape are triangular in cross-section.

7. The draw tape bag recited in claim 4 wherein said elements embedded in said tape are cylindrical in cross-section.

8. The draw tape bag recited in claim 1 wherein said ribs are embossed in said tape to form a plurality of areas of increased thickness in said tape.

9. The draw tape bag recited in claim 8 wherein said draw tape is of 1 mil±15% thickness, with 2 mil±15% thickness ribs.

10. The draw tape bag recited in claim 1 wherein said ribs are spaced along said tape to provide approximately 5% by weight or volume of said tape.

11. The draw tape bag recited in claim 1 wherein said ribs are triangular in cross-section.

12. The draw tape bag recited in claim 11 wherein said ribs have two sides disposed at 45° angles with respect to said draw tape.

13. The draw tape bag recited in claim 1 wherein said draw tape and said ribs are high molecular weight, high density polyethylene.

14. A draw tape bag for carrying trash and the like comprising:

two panels forming an open top, closed bottom bag, said panels being joined along the sides of said bag, a hem on said panels being folded over adjacent said top, the bottom of said hem being secured to the adjacent panel;

a draw tape in said hem secured at said sides to said panels, said draw tape having a plurality of ribs, each having a thickness greater than the thickness of said tape, each rib being formed by elements which are relatively stiff, relative to said tape, each of said elements being embedded in said tape, wherein said tape is formed of two layers with said elements being embedded between said layers.

* * * * *